US008864538B1

(12) United States Patent
Arbuckle et al.

(10) Patent No.: US 8,864,538 B1
(45) Date of Patent: Oct. 21, 2014

(54) SYSTEMS AND METHODS FOR COOLING MARINE PROPULSION SYSTEMS ON MARINE VESSELS IN DRYDOCK

(71) Applicant: Brunswick Corporation, Lake Forest, IL (US)

(72) Inventors: Jason S. Arbuckle, Horicon, WI (US); Daniel J. Balogh, Menasha, WI (US); Matthew S. Krabacher, North Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 98 days.

(21) Appl. No.: 13/749,297

(22) Filed: Jan. 24, 2013

(51) Int. Cl.
*B63H 21/14* (2006.01)
*B63H 21/38* (2006.01)

(52) U.S. Cl.
CPC ..... *B63H 21/383* (2013.01)
USPC ..... 440/88 C; 440/88 P; 440/88 HE

(58) Field of Classification Search
CPC .. B63B 2770/00; F01P 3/202; F01P 2025/04; F01P 2025/06; F01P 2031/20; F01P 5/12; F01P 3/207; F01P 11/20; F01P 2050/06; F02B 61/045
USPC ..... 440/88 P, 88 C, 88 M, 88 HE, 6; 123/41.02, 41.05, 41.15, 198 D
See application file for complete search history.

(56) References Cited

U.S. PATENT DOCUMENTS 3,793,997 A * 2/1974 Banner ..... 123/41.15
4,322,633 A 3/1982 Staerzl
4,524,736 A * 6/1985 Sackett ..... 123/198 D
4,630,036 A * 12/1986 Ford ..... 340/622
6,183,625 B1 2/2001 Staerzl
6,273,771 B1 8/2001 Buckley et al.
6,822,462 B1 11/2004 Staerzl
6,841,059 B1 1/2005 Staerzl
7,094,118 B1 8/2006 Phillips et al.
7,370,611 B1 * 5/2008 White et al. ..... 123/41.01
7,503,819 B1 3/2009 Jaeger et al.
8,298,025 B2 10/2012 Eichinger
2011/0280705 A1 * 11/2011 England et al. ..... 415/1

OTHER PUBLICATIONS

2010 Marine Gauge Products Brochure, 11 pages.
Vapor Separator Components Parts, available at http://www.marinepowerservice.com/BoatingStore/lookup_parts_mercyear2.cfm/coll_style/ . . . , last visited Jan. 2, 2013, 3 pages.

(Continued)

*Primary Examiner* — Stephen Avila
*Assistant Examiner* — Anthony Wiest
(74) *Attorney, Agent, or Firm* — Andrus Intellectual Property Law LLP

(57) ABSTRACT

Systems and methods are for cooling a marine propulsion system on a marine vessel. A lift pump pumps raw cooling water from a body of water in which the marine vessel is situated. The lift pump pumps the raw cooling water through an open cooling circuit from an upstream inlet for receiving the raw cooling water to a downstream outlet for discharging the cooling water back to the body of water. A control circuit controls operation of the lift pump. At least one sensing device indicates whether the lift pump is connected to the body of water. The sensing device is in communication with the control circuit. The control circuit prevents operation of the lift pump when the sensing device indicates that the lift pump is not connected to the body of water.

18 Claims, 4 Drawing Sheets

(56) References Cited

OTHER PUBLICATIONS

P39/P79 Smart Sensors Brochure, available at http://www.airmar.com, last visited Jan. 2, 2013, 2 pages.
P39—Transom Mount, Smart Sensor Description, available at http://www.airmartechnology.com/2009/products/marine-product.asp-?prodid=28&manf= . . . , last visited Dec. 27, 2012, 2 pages.
Catalog page for Standard Motor Products, Inc., available at http://www.rockauto.com/catalog/moreinfo.php? pk=443724 &cc=1420467, last visited Jan. 2, 2013, one page.

* cited by examiner

SYSTEMS AND METHODS FOR COOLING MARINE PROPULSION SYSTEMS ON MARINE VESSELS IN DRYDOCK

FIELD

The present disclosure relates to marine propulsion systems and more particularly to cooling systems and methods for marine propulsion systems.

BACKGROUND

U.S. Pat. No. 4,322,633, which is incorporated herein by reference in entirety, discloses a marine cathodic protection system that maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

U.S. Pat. No. 6,183,625, which is incorporated herein by reference in entirety, discloses a galvanic monitor system that uses two annunciators, such like light emitting diodes, to alert a boat operator of the current status of the boat's galvanic protection system. A reference electrode is used to monitor the voltage potential at a location in the water and near the component to be protected. The voltage potential of the electrode is compared to upper and lower limits to determine if the actual sensed voltage potential is above the lower limit and below the upper limit. The two annunciator lights are used to inform the operator if the protection is proper or if the component to be protected is either being over protected or under protected.

U.S. Pat. No. 6,273,771, which is incorporated herein by reference in entirety, discloses a control system for a marine vessel incorporates a marine propulsion system that can be attached to a marine vessel and connected in signal communication with a serial communication bus and, a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 6,841,059, which is incorporated herein by reference in entirety discloses a monitor for use in conjunction with a galvanic protection system for a marine vessel, which provides automatic and continuous monitoring of a voltage at a reference electrode of the galvanic protection system and displays the results continuously by energizing one or more of a plurality of annunciators, such as light emitting diodes. The light emitting diodes are energized in groups of one or two in order to double the effective resolution of a group of ten annunciators. The selected annunciators are energized intermittently in order to conserve electrical power while continuously and automatically running. The frequency of activation of the selected annunciators is changed whenever the voltage potential being monitored falls within a minimum range or a maximum range in order to alert the operator of a potentially catastrophic result. A lower frequency is used when the monitor voltage is not within these minimum and maximum ranges.

U.S. Pat. No. 7,503,819, which is incorporated herein by reference in entirety, discloses cooling system for a marine propulsion device provides a closed portion of the cooling system which recirculates coolant through the engine block and cylinder head, the exhaust manifold, and the exhaust elbow. It provides a pressure relief cap connected to the exhaust elbow and a low velocity portion of the coolant jacket of the exhaust elbow to facilitate the release of gas and coolant when pressures exceed a preselected magnitude.

U.S. patent application Ser. No. 13/100,037, filed May 3, 2011, expressly incorporated herein in entirety by reference, discloses systems and methods for operating a marine propulsion system. The systems and methods utilize an internal combustion engine and an electric motor that is powered by a battery, wherein the internal combustion engine and the electric motor each selectively power a marine propulsor to propel a marine vessel. A control circuit is operated to control operation of the system according to a plurality of modes including at least an electric mode wherein the electric motor powers the marine propulsor and a hybrid mode wherein the internal combustion engine powers the marine propulsor and provides power for recharging the battery. An operator-desired future performance capability of the hybrid marine propulsion system is input to the control circuit, which selects and executes the plurality of modes so as to provide the operator-desired future performance capability.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In some examples, methods are for cooling a marine propulsion system on a marine vessel. The methods comprise: (1) pumping with a lift pump raw cooling water from a body of water in which the marine vessel is situated through an open cooling circuit from an upstream inlet for receiving the raw cooling water to a downstream outlet for discharging the cooling water back to the body of water; (2) determining with at least one sensing device whether the lift pump is connected to the body of water, wherein the sensing device is in communication with a control circuit; and (3) preventing with the control circuit operation of the lift pump when the sensing device indicates that the lift pump is not connected to the body of water.

In other examples, methods are for cooling a marine propulsion system on a marine vessel. The methods comprise (1) pumping raw cooling water from a body of water in which the marine vessel is situated through an open cooling circuit from an upstream inlet for receiving the raw cooling water to a downstream outlet for discharging the raw cooling water back to the body of water; (2) pumping cooling fluid for cooling a battery bank on the marine vessel through a closed cooling circuit; (3) facilitating with a heat exchanger an exchange of heat between the raw cooling water in the open cooling circuit and the cooling fluid in the closed cooling circuit so as to cool the cooling fluid in the closed cooling circuit; (4) sensing water with a water sensor to determine whether the lift pump is connected to the body of water, the water sensor being in communication with a control circuit; (4) sensing with a depth transducer a depth of the body of water in which the marine vessel is disposed, the depth transducer being in communication with the control circuit; (5) applying electricity to a corrosive preventing submergible anode, the control circuit sensing a voltage of the submergible anode; and (6) preventing with the control circuit operation of the lift pump when at least one of the water sensor senses water, the depth transducer senses a depth, and the voltage of the submergible anode is outside of a threshold value.

In other examples, systems are for cooling a marine propulsion system on a marine vessel. The systems comprise a lift pump that pumps raw cooling water from a body of water in which the marine vessel is situated. The lift pump pumps the raw cooling water through an open cooling circuit from an upstream inlet for receiving the raw cooling water to a downstream outlet for discharging the cooling water back to the body of water. A control circuit controls operation of the lift pump; and at least one sensing device that indicates whether the lift pump is connected to the body of water. The sensing device is in communication with the control circuit. The control circuit prevents operation of the lift pump when the sensing device indicates that the lift pump is not connected to the body of water.

BRIEF DESCRIPTION OF THE DRAWINGS

Examples of marine propulsion systems and cooling systems and methods for marine propulsion systems are described with reference to the following figures. The same numbers are used throughout the figures to reference like features and components.

DETAILED DESCRIPTION OF THE DRAWINGS

Figure 1:
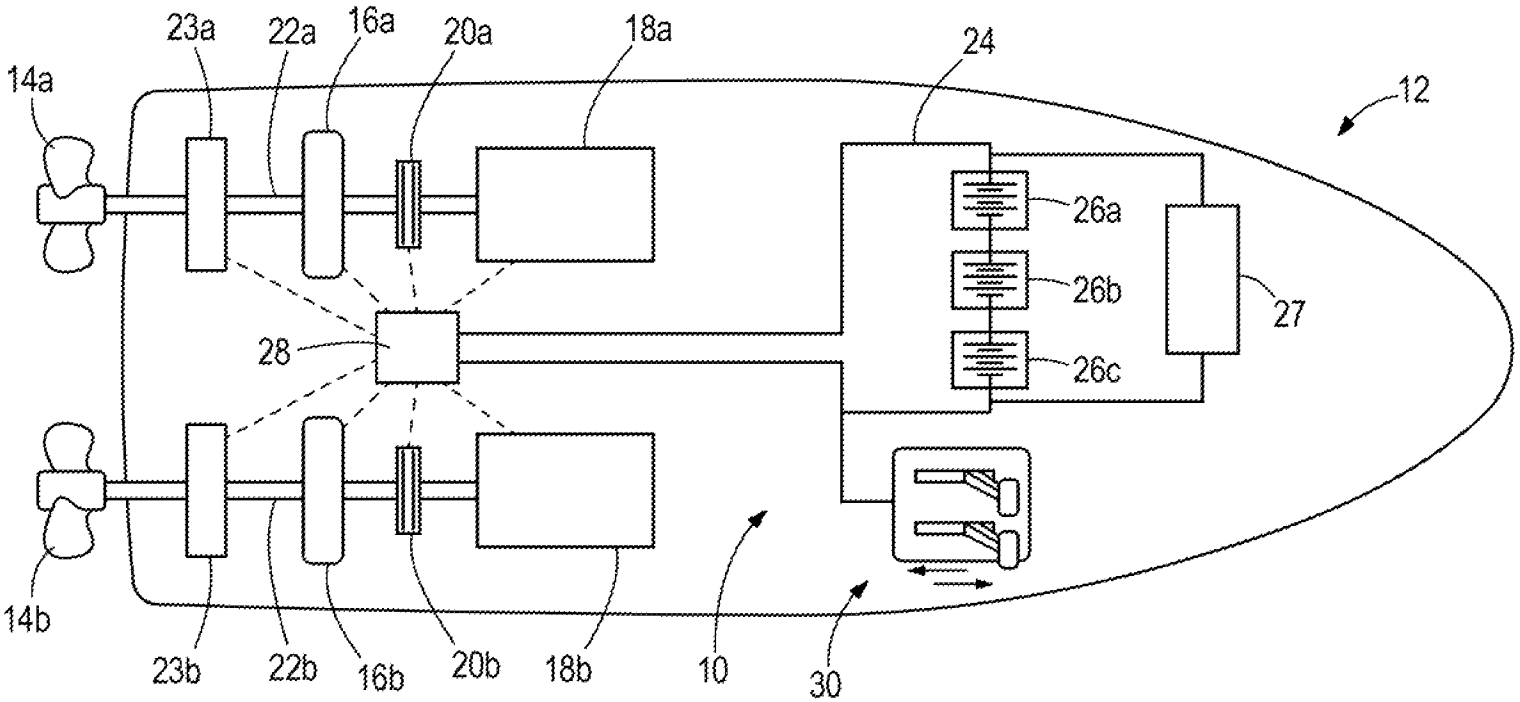
FIG. 1 is a schematic depiction of a hybrid marine propulsion system for a marine vessel.

FIG. 1 schematically depicts a hybrid marine propulsion system 10 for a marine vessel 12. The system 10 includes among other things one or more propulsors 14*a*, 14*b* (collectively referred to herein as "propulsors 14"), which can include any type of device for propelling the marine vessel 12, including but not limited to one or more propellers (as shown in FIG. 1), impellers, stern drives, pod drives, and/or the like. As described herein, the propulsors 14 can each be driven into rotation by one or more electric motor-generators 16*a*, 16*b* (collectively referred to herein as "motor-generators 16"), one or more internal combustion engines 18*a*, 18*b* (collectively referred to herein as "engines 18"), and/or a combination of the motor-generators 16 and engines 18.

The engines 18 can include diesel engines or any other conventional internal combustion-type engines for applying torque to and thereby rotating driveshafts 22*a*, 22*b* (collectively referred to herein as "driveshafts 22") in a conventional manner. In the example shown, the system 10 also includes one or more clutches 20*a*, 20*b* (collectively referred to herein as "clutches 20") for connecting the engines 18 and the driveshafts 22 in a torque-transmitting manner (i.e. such that rotation of the engines 18 applies torque to and thereby can cause rotation of the driveshafts 22). The clutches 20 can include any conventional type of clutch for connecting and disconnecting engines 18 and driveshafts 22 in the noted torque-transmitting manner, such as for example friction clutches, or more preferably dog clutches because the speeds of the motor-generators 16 and engines 18 are typically synchronized (i.e. substantially matched) before the clutches 20 are engaged or disengaged. Conventional transmissions 23*a*, 23*b* (collectively referred to herein as "transmissions 23") connect the other ends of driveshafts 22 to the propulsors 14 in a torque-transmitting manner, so that rotation of the driveshafts 22 causes movement of the propulsors 14 for forward and/or reverse propulsion in a conventional manner. The transmissions 23 are configured to connect the driveshafts 22 to the propulsors 14 in forward gear wherein forward rotation is applied by the transmissions 23 to the propulsors 14 for forward thrust, reverse gear wherein reverse rotation is applied by the transmissions 23 to the propulsors 14 for reverse thrust, and neutral gear wherein no rotation is applied by the transmissions 23 to the propulsors 14.

The motor-generators 16 are located between the clutches 20 and transmissions 23 and are configured to engage with and/or drive (i.e. apply torque to and/or rotate) the driveshafts 22 at the same time or separately from the engines 18. The motor-generators 16 can alternately apply positive and negative torque on the driveshafts 22 with respect to the positive torque applied by the engines 18. Rotation of the motor-generator 16 in one direction thus can cause positive rotation of the driveshafts 22. Rotation of the motor-generator 16 in an opposite direction thus can slow or impede rotation of the driveshafts 22 and also can cause negative rotation of the driveshafts 22. In the example shown, the driveshafts 22 extend through and form a part of the motor-generators 16. Arrangements where the motor-generators 16 and driveshafts 22 are oriented differently with respect to each other or are separate components that are operatively coupled are also contemplated and are part of this disclosure. For example, the motor-generators 16 can be linked in torque-transmitting relation with the driveshafts 22 via a gearbox containing for example planetary gears, sun gears, and/or ring gears for engaging the motor-generators 16 with the driveshafts 22 in the noted torque-transmitting manner.

The system 10 also includes a plurality of rechargeable storage batteries 26*a*, 26*b*, 26*c* (collectively herein referred to as "batteries 26"), which are electrically connected to the motor-generators 16. The batteries 26 provide power to the motor-generators 16 during operation of the motor-generators 16 to apply torque to the driveshafts 22. In FIG. 1, three batteries 26*a*, 26*b*, 26*c* are shown in banks and are coupled in series with each other and to the motor-generators 16; however the number of batteries 26 and the configuration thereof can vary from that shown. One or more batteries 26 could be employed. One commercial type of rechargeable battery 26 for use in the hybrid marine propulsion system 10 is available from Valence Technology Inc. Other similar types of rechargeable batteries can be commercially obtained and used in the system 10. In use, the batteries 26 provide power to the motor-generator 16 to facilitate its operation. The batteries 26 are also electrically connected to and provide power a house load 27 of the marine vessel 12 when the system 10 is not connected to a shore power source. The house load 27 can include any electrical power drawing component on the marine vessel 12 other than the motor-generator 16 and its related control circuitry described herein below. For example the house load 27 can include radios, air conditioning, microwave ovens, televisions, and/or other like electrical components on-board the marine vessel 12.

The motor-generators 16 are also configured to generate power for recharging the batteries 26. More specifically, the engines 18 can be connected to and cause rotation of the driveshafts 22 via the clutches 20, as described herein above. The motor-generators 16 can apply negative torque on the driveshafts 22, as described herein above, and thereby function as a conventional generator that generates power from rotation of the driveshafts 22 by the engines 18. The power generated by the motor-generator can then be applied to the batteries 26 to recharge the batteries 26.

As described herein above, the engines 18, clutches 20, motor-generators 16 and transmissions 23 are configured to provide forward, neutral, and reverse operations of the propulsors 14 in a conventional "parallel drive hybrid arrangement"; however the examples shown and described herein are not limited to this arrangement and the concepts discussed herein are applicable to other types of parallel and/or non-parallel (e.g. series) hybrid marine propulsion configurations. In a conventional parallel hybrid drive arrangement, typically the engines 18 are a primary source of power to drive the propulsor 14 and the motor-generator 16 is a co-primary or a secondary source of torque to drive the propulsor 14. Alternatively, in a series hybrid drive arrangement, generally the motor-generator 16 is the primary source of torque to drive the propulsor 14 and the engines 18 is typically used principally or solely to drive the motor-generator 16 as a generator to supply electrical power to the battery 26.

The system 10 also includes a control circuit 28 having a memory and a programmable processor. As is conventional, the processor can be communicatively connected to a computer readable medium that includes volatile or nonvolatile memory upon which computer readable code is stored. The processor can access the computer readable code and the computer readable medium upon executing the code carries out the functions as described herein. In this particular example, the control circuit 28 includes a controller area network bus 24 (CAN bus) for operating the system 10 in a plurality of operational modes. An example of CAN-type systems are disclosed in U.S. Pat. No. 6,273,771 and U.S. patent application Ser. No. 13/100,037, which are incorporated herein by reference.

Figure 2:
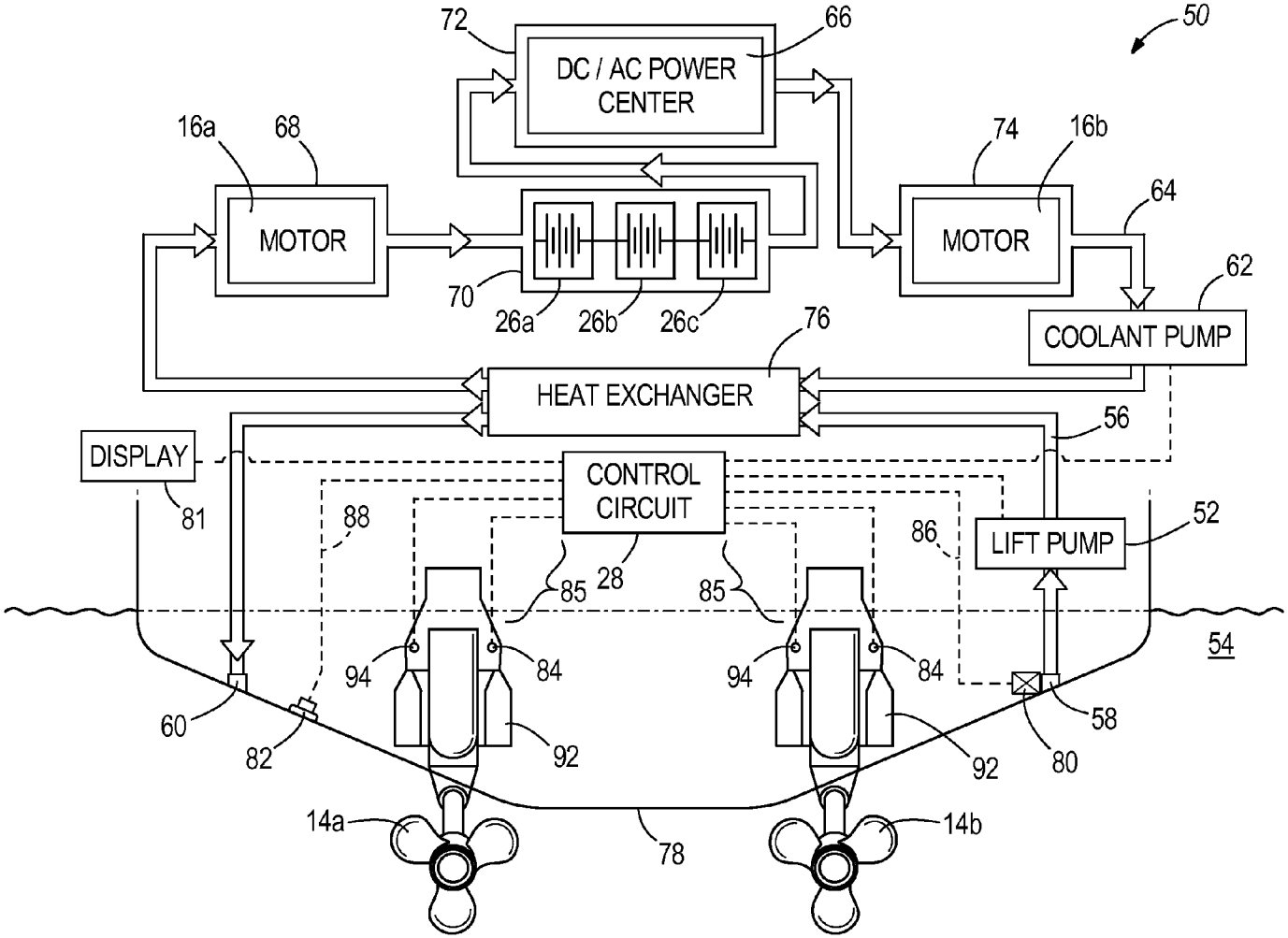
FIG. 2 is a schematic depiction of a system for cooling the hybrid marine propulsion.

FIG. 2 depicts a cooling system 50 for cooling various components of the hybrid marine propulsion system 10. The cooling system 50 includes a lift pump 52 configured to pump water from a body of water 54 in which the marine vessel 12 is situated through an open cooling circuit 56 from an upstream inlet 58 for receiving the raw cooling water to a downstream outlet 60 for discharging the cooling water back to the body of water 54. The type of lift pump 52 can vary and examples of a suitable lift pump 52 include a centrifugal pump/impeller pump or a positive displacement pump.

A coolant pump 62 is also provided for pumping cooling fluid, for example glycol, through a closed cooling circuit 64 for cooling components of the hybrid marine propulsion system 10, including for example the motor-generators 16, batteries 26 and an associated DC/AC power center 66, among other components. The power center 66 is an integrated electrical converter assembly for providing a connection to a source of shore power and switching between vessel battery power and shore power. The power center 66 integrates several power converters into a single component. The type of coolant pump 62 and cooling fluid can vary and examples of a suitable coolant pump 62 include a centrifugal pump/impeller pump or a positive displacement pump. The closed cooling circuit 64 conveys cooling fluid through cooling jackets and passages 68, 70, 72, 74 for exchanging heat with and thereby cooling the motor-generators 16, batteries 26 and power center 66 in a conventional manner.

A fluid-to-fluid heat exchanger 76 facilitates exchange of heat between the raw cooling water in the open cooling circuit 56 and the cooling fluid in the closed cooling circuit 64 so that the relatively cool raw cooling water in the open cooling circuit 56 reduces the temperature of the relatively hot cooling fluid in the cooling circuit 64. The type of heat exchanger 76 can vary and one type of such a heat exchanger is disclosed in the incorporated U.S. Pat. No. 7,503,819 and another example is disclosed in the incorporated U.S. Pat. No. 7,094,118.

The hybrid marine propulsion system 10 is exemplary and for discussion purposes only. The concepts of the present disclosure can be applied to alternate hybrid and/or non-hybrid propulsion systems. The cooling system 50 is also exemplary and for discussion purposes only. The concepts of the present disclosure can be applied to different cooling systems, such as those disclosed in the incorporated U.S. Pat. No. 7,503,819 and/or U.S. Pat. No. 8,298,025.

The present disclosure arose during research and development of systems and methods for cooling marine propulsion systems, and particularly cooling systems that incorporate a lift pump 52 for pumping raw cooling water from a body of water 54 in which the marine vessel 12 is situated. As discussed herein above, the hybrid marine propulsion system 10 incorporates one or more rechargeable batteries (e.g. 26), which are cooled by operation of the coolant pump 62 and the noted heat exchange with coolant flowing through the coolant jacket and passages 70. Similarly, the power center 66 and motor-generators 16 also include coolant jackets and passages 72, 68, 74 for heat exchange with the cooling fluid. The inventors have realized that when the marine vessel 12 is removed from the water for storage, a source of shore power typically will be connected to the power center 66 for maintaining the batteries 26 at a predetermined charge level. During storage, the control circuit 28 typically will operate the coolant pump 62 to pump cooling fluid through the closed cooling circuit 64 so as to exchange heat with and maintain a preferred temperature of the batteries 26, power center 66 and motor-generators 16. Conventional temperature sensors that are typically associated with the batteries 26, for example, are monitored by the control circuit 28 and the control circuit 28 operates the coolant pump 62 when the temperature of the batteries 26 drops below a stored threshold in the control circuit 28 or rises above a stored threshold in the control circuit 28. The closed cooling circuit 64 contains cooling fluid and therefore operating the coolant pump 62 when the marine vessel 12 is not in the body of water 54 typically is not problematic. However, the inventors have realized that the lift pump 52 can be damaged if it operates dry, i.e. when the marine vessel 12 is not connected to the body of water 54, i.e. able to draw water therefrom. The inventors have realized that it is desirable to provide systems and methods for identifying whether or not the marine vessel 12 (and with it, the lift pump 52) is situated in the body of water 54 so that the lift pump 52 can draw water therefrom before permitting operation of the lift pump 52 by the control circuit 28.

Referring to FIG. 2, the system 50 includes one or more sensing device(s) 80, 82, 84 for indicating to the control circuit 28 whether or not the lift pump 52 is connected to the body of water 54. The nature of the sensing device 80, 82, 84 can vary, as described herein below, and advantageously can include one or more devices that are already present in a conventional marine propulsion system. As explained herein below, the inclusion of more than one sensing device also can advantageously allow for verification that the respective sensing devices are properly operating.

The sensing device 80 includes a water sensor that is connected in communication with the control circuit 28. The water sensor 80 communicates with the control circuit 28 via for example an analog switch input along a wired link 86. The exact type of water sensor 80 can vary and in some examples can include a water-in-fuel sensor that is currently commercially available from Mercury Marine (Brunswick Corporation) under part number 8285861. This type of water sensor 80 is a metallic element connected to an analog pin that is pulled up to 5 volts on the control circuit 28. The control circuit 28 is programmed to measure the voltage on the pin and to signal an alarm to the operator via an audible or visual display 81, such as a video screen or other similar type of feedback device. In the example shown, the water sensor 80 is located on the hull 78 of the marine vessel 12, adjacent to the upstream inlet 58 of the open cooling circuit 56. The body of water 54 is more conductive than air and therefore when the water sensor 80 is disposed in the body of water 54 a current will flow from the control circuit 28, via the link 86, and through the water sensor 80 and the body of water 54 to ground. The control circuit 28 is programmed to conclude that the lift pump 52 is connected to the body of water 54 when voltage of the water sensor 80 is within a certain voltage range stored in the control circuit 28. The control circuit 28 is programmed to conclude that the lift pump 52 is not connected to the body of water 54 when voltage of the water sensor 80 is outside of the voltage range. In other embodiments, different types of water sensors 80 could be employed, such as a conventional coolant level sensor commonly utilized to detect coolant level, commercially available from RockAuto.com. In this example, a two pin device (one sensor, one ground) is mounted in a plastic tank. These examples are not intended to be limiting, and the exact type of water sensor can vary.

The sensing device 82 includes a depth transducer located on the hull 78 of the marine vessel 12. The depth transducer 82 is in communication with the control circuit 28 via a wired or wireless communication link 88. The type of depth transducer 82 can vary and in one example includes a smart sensor that is commercially available from Airmar Technology Corporation under part numbers P39, P79. In this example, the depth transducer 82 receives sequences of high voltage electrical pulses from a conventional built-in echosounder. The depth transducer 82 converts the transmit pulses into sound, which travels through the body of water 54 as pressure waves. When a pressure wave strikes an object, such as a weed or a rock, or the bottom of the body of water 54, the wave bounces back to the depth transducer 82. When the wave of sound bounces back, the depth transducer 82 receives the sound wave during the time between each transmit pulse and converts it back into electric energy. The echosounder is configured to calculate the time difference between a transmit pulse and the return echo and then communicate this information to the control circuit 28 via the wired or wireless link 88. The control circuit 28 is configured to conclude that the lift pump 52 is not connected to the body of water 54 when the depth transducer 82 does not produce a valid water depth reading. The depth transducer 82 does not provide a valid depth reading when it is not disposed in water.

In another example, the sensing device 84 includes one or more corrosive preventing submergible anode, which is one component of a conventional marine cathodic protection system 85, such as those described in the incorporated U.S. Pat. Nos. 4,322,633 and 6,183,625. This type of system 85 is commercially available from Mercury Marine (Brunswick Corporation) under the trademark Mercathode. Conventional cathodic protection systems prevent galvanic corrosion of marine components. A solid state device, in this example the control circuit 28, operates with power provided by a battery, in this example the batteries 26. The system 85 provides galvanic protection by impressing a reverse blocking current that stops the destructive flow of galvanic currents through the body of water 54 in the vicinity of the drive units 92 to which the propulsors 14 are engaged. The particular configuration of the system 85 can vary, as demonstrated by the incorporated patents and the commercially available products. In the example shown, the system 85 includes the control circuit 28, which is connected by wired links to reference electrodes 94 and the anodes 84. The reference electrodes 94 sense the corrosion potential of the respective drive units 92 disposed in the body of water 54 and communicate with the control circuit 28 to keep the protective current within a prescribed range for optimum blocking and hence, optimal corrosion protection. The protective current from the batteries 26 is emitted into the water via the control circuit 28 and anodes 84. The surface of each anode 84 is generally platinum coated so that it will not corrode due to the current flow, like sacrificial anodes would under these same circumstances. The control circuit 28 of the system 85 automatically adjusts itself to compensate for changes in corrosion potential caused by variations in water temperature, velocity, and conductivity. It also compensates for changes in the condition of the paint on the drive units 92. The anodes 84 and related system 85 are utilized by the cooling system 50 of FIG. 2 to detect whether the lift pump 52 is out of the body of water 54. Specifically, the control circuit 28 is configured to make this determination when the anodes 84 produce a voltage that is outside of a predetermined or stored range saved in a memory of the control circuit 28.

When one or more of the sensing devices 80, 82, 84 indicate that the lift pump 52 is out of the body of water 54, as discussed above, the control circuit 28 is programmed to prevent operation of the lift pump 52. The system 50 can include each of the noted sensing devices 80, 82, 84. In examples where there are two or more sensing devices 80, 82, 84 provided in the system 50, the control circuit 28 can advantageously be programmed to identify a fault when it is determined that one of the sensing devices 80, 82, 84 indicates that the lift pump 52 is out of the body of water 54 and another of the sensing devices 80, 82, 84 indicates that the lift pump 52 is in the body of water 54. If the outputs from any one of the sensing devices 80, 82, 84 are nonconforming with the other sensing devices 80, 82, 84, the control circuit 28 can communicate with the display 81 for providing an alert to the operator.

Figure 3:
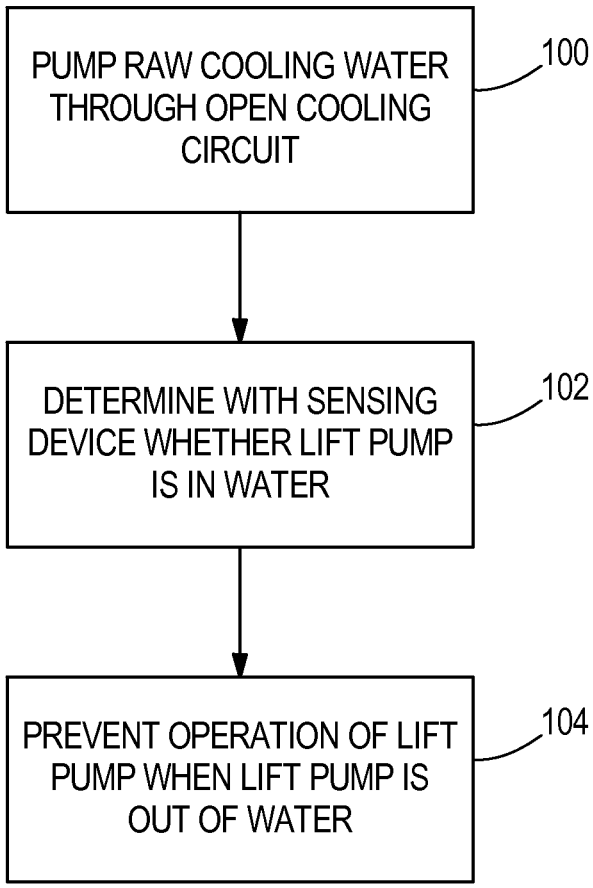
FIG. 3 is a flow chart depicting a method of cooling the hybrid marine propulsion system.

The control circuit 28 can thus be programmed to carry out method steps for operating the noted cooling system 50. In the example shown in FIG. 3, at step 100, the lift pump 52 is operated to pump raw cooling water from the body of water 54 in which the marine vessel 12 is situated through the open cooling circuit 56 from the upstream inlet 58 for receiving the raw cooling water to the downstream outlet 60 for discharging the raw cooling water back to the body of water 54. At step 102, at least one sensing device 80, 82, 84 indicates whether the lift pump 52 is disposed in the body of water 54. The sensing device 80, 82, 84 is communicatively connected to the control circuit 28. At step 104, the control circuit 28 is operated to prevent operation of the lift pump 52 when the control circuit 28 determines that the lift pump 52 is out of the body of water 54.

Figure 4:
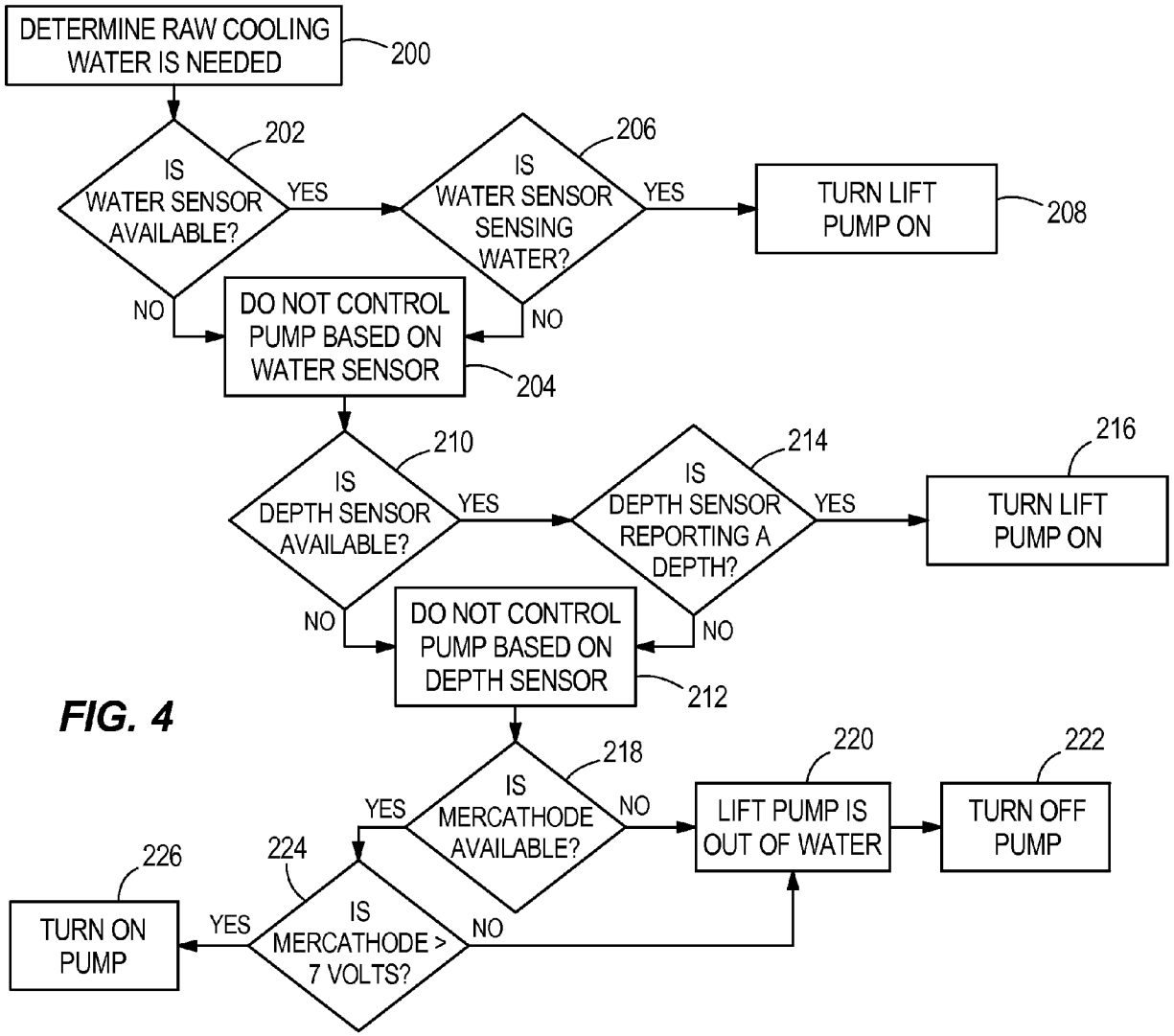
FIG. 4 is a flow chart depicting another method of cooling the hybrid marine propulsion system.

In the example shown in FIG. 4, at step 200, the control circuit 28 determines whether raw cooling water is needed to provide cooling via the heat exchanger 76 to the cooling fluid in the closed cooling circuit 64. This can be determined by the control circuit 28 based upon its monitoring of temperature levels in, for example, the batteries 26 or cooling jackets 70 thereof. At step 202, the control circuit 28 determines whether it can receive signals via the link 86 from the water sensor 80. If no, at step 204, the control circuit 28 does not control the lift pump 52 based upon inputs from the water sensor 80. If yes, at step 206, the control circuit 28, at step 206, determines whether the water sensor 80 is sensing water. If no, at step 204, the control circuit 28 does not control the lift pump 52 based upon inputs from the water sensor 80. If yes, at step 208, the control circuit 28 turns on the lift pump 52 and provide raw cooling water to the heat exchanger 76 via the open cooling circuit 56. At step 210, the control circuit 28 determines whether it is receiving signals from the depth transducer 82 via the link 88. If no, at step 212, the control circuit 28 does not control the lift pump 52 based upon signals from the depth transducer 82. If yes, at step 214, the control circuit 28 determines whether the depth transducer 82 is providing a valid depth reading. If no, at step 212, the control circuit 28 does not control the lift pump 52 based on inputs from the depth transducer 82. If yes, at step 216, the control circuit 28 turns on the lift pump 52 and provide raw cooling water to the heat exchanger 76 via the open cooling circuit 56. At step 218, the control circuit 28 determines whether it is receiving a voltage reading from the system 85. If no, at step 220, the control circuit 28 determines that the lift pump 52 is not connected to the body of water 54 and then at step 222, the control circuit 28 turns off the lift pump 52. If yes, at step 224, the control circuit 28 determines whether the voltage from the submergible anode 84 is greater than a threshold, for example seven volts. If no, the control circuit 28 proceeds to the aforementioned step 220. If yes, at step 226, the control circuit 28 turns on the lift pump 52 and pump raw cooling water from the body of water 54 to the heat exchanger 76 via the open cooling circuit 56.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

What is claimed is:

1. A method for cooling a marine propulsion system on a marine vessel, the method comprising pumping with a lift pump raw cooling water from a body of water in which the marine vessel is situated through an open cooling circuit from an upstream inlet for receiving the raw cooling water to a downstream outlet for discharging the raw cooling water back to the body of water; indicating with at least one sensing device whether the lift pump is connected to the body of water, wherein the sensing device is in communication with a control circuit; and preventing with the control circuit operation of the lift pump when the sensing device indicates that the lift pump is not connected to the body of water;

wherein the at least one sensing device comprises a depth transducer disposed on a hull of the marine vessel, and further comprising determining with the control circuit that the lift pump is not connected to the body of water when the depth transducer does not indicate a water depth reading.

2. A method for cooling a marine propulsion system on a marine vessel, the method comprising pumping with a lift pump raw cooling water from a body of water in which the marine vessel is situated through an open cooling circuit from an upstream inlet for receiving the raw cooling water to a downstream outlet for discharging the raw cooling water back to the body of water; indicating with at least one sensing device whether the lift pump is connected to the body of water, wherein the sensing device is in communication with a control circuit; and preventing with the control circuit operation of the lift pump when the sensing device indicates that the lift pump is not connected to the body of water;

wherein the at least one sensing device comprises a corrosive preventing submergible anode disposed on a drive of the marine vessel, and further comprising determining with the control circuit that the lift pump is not connected to the body of water when the submergible anode has a voltage that is outside of a predetermined voltage range saved ma memory of the control circuit.

3. A method for cooling a marine propulsion system on a marine vessel, the method comprising pumping with a lift pump raw cooling water from a body of water in which the marine vessel is situated through an open cooling circuit from an upstream inlet for receiving the raw cooling water to a downstream outlet for discharging the raw cooling water back to the body of water; indicating with at least one sensing device whether the lift pump is connected to the body of water, wherein the sensing device is in communication with a control circuit; and preventing with the Control circuit operation of the lift pump when the sensing device indicates that the lift pump is not connected to the body of water;

wherein the at least one sensing device comprises at least two sensing devices selected from the group consisting of a water sensor, a depth transducer, and an anode/cathode; and further comprising preventing with the control circuit operation of the lift pump when the control circuit determines that one or more of the sensing devices in the plurality of sensing devices indicates that the lift pump is not connected to the body of water.

4. The method according to claim 3, wherein the at least one sensing device comprises a water sensor disposed on a hull of the marine vessel, and further comprising determining with the control circuit that the lift pump is not connected to the body of water when the water sensor does not sense water.

5. The method according to claim 3, further comprising diagnosing with the control circuit a system fault when the control circuit determines that one of the sensing devices in the plurality indicates that the lift pump is not connected to the body of water and another of the sensing devices in the plurality indicates that the lift pump is connected to the body of water.

6. The method according to claim 5, comprising controlling with the control circuit a display to indicate the system fault to an operator.

7. A system for cooling a marine propulsion system on a marine vessel, the system comprising a lift pump that pumps raw cooling water from a body of water in which the marine vessel is situated, wherein the lift pump pumps the raw cooling water through an open cooling circuit from an upstream inlet for receiving the raw cooling water to a downstream outlet for discharging the cooling water back to the body of water; a control circuit that controls operation of the lift pump; and at least one sensing device that indicates whether the lift pump is connected to the body of water, the sensing device being in communication with the control circuit; wherein the control circuit prevents operation of the lift pump when the sensing device indicates that the lift pump is not connected to the body of water;

Wherein the at least one sensing device comprises a depth transducer, and wherein the control circuit determines that the lift pump is not connected to the body of water when the depth transducer does not produce a valid water depth reading.

8. The system according to claim 7, wherein the depth transducer is located on a hull of the marine vessel.

9. A system for cooling a marine propulsion system on a marine vessel, the system comprising a lift pump that pumps raw cooling water from a body of water in which the marine vessel is situated, wherein the lift pump pumps the raw cooling water through an open cooling circuit from an upstream inlet for receiving the raw cooling water to a downstream outlet for discharging the cooling water back to the body of water; a control circuit that controls operation of the lift pump; and at least one sensing device that indicates whether the lift pump is connected to the body of water, the sensing device being in communication with the control circuit; wherein the control circuit prevents operation of the lift pump when the sensing device indicates that the lift pump is not connected to the body of water;

wherein the at least one sensing device comprises a corrosive preventing submergible anode, and wherein the control circuit determines that the lift pump is not connected to the body of water when the submergible anode has a voltage that is outside of a predetermined range saved in a memory of the control circuit.

10. The system according to claim 9, wherein the submergible anode is disposed on a drive unit depending from the marine vessel.

11. A system for cooling a marine propulsion system on a marine vessel, the system comprising a lift pump that pumps raw cooling water from a body of water in which the marine vessel is situated, wherein the lift pump pumps the raw cooling water through an open cooling circuit from an upstream inlet for receiving the raw cooling water to a downstream outlet for discharging the cooling water back to the body of water; a control circuit that controls operation of the lift pump; and at least one sensing device that indicates whether the lift pump is connected to the body of water, the sensing device being in communication with the control circuit; wherein the control circuit prevents operation of the lift pump when the sensing device indicates that the lift pump is not connected to the body of water;

wherein the at least one sensing device comprises at least two sensing devices selected from the group consisting of a water sensor, a depth transducer, and a submergible anode, and wherein the control circuit prevents operation of the lift pump when the control circuit determines that one or more of the sensing devices in the plurality indicates that the lift pump is not connected to the body of water.

12. The system according to claim 11, comprising a coolant pump that pumps cooling fluid for cooling a battery bank on the marine vessel through a closed cooling circuit; and a heat exchanger that facilitates exchange of heat between the raw cooling water in the open cooling circuit and the cooling fluid in the closed cooling circuit so as to cool the cooling fluid in the closed cooling circuit.

13. The system according to claim 11, wherein the at least one sensing device comprises a water sensor disposed on a hull of the marine vessel, and wherein the control circuit determines that the lift pump is not connected to the body of water when the water sensor does not sense water.

14. The system according to claim 13, wherein the water sensor is located adjacent to the inlet of the open cooling circuit.

15. The system according to claim 11, wherein the control circuit further diagnoses a system fault when the control circuit determines that one of the sensing devices in the plurality indicates that the lift pump is connected to the body of water and another of the sensing devices in the plurality indicates that the lift pump is not connected to the body of water.

16. The system according to claim 15, comprising a display, wherein the control circuit controls the display to indicate the system fault to an operator.

17. A method for cooling a marine propulsion system on a marine vessel, the method comprising:

pumping raw cooling water from a body of water in which the marine vessel is situated through an open cooling circuit from an upstream inlet for receiving the raw cooling water to a downstream outlet for discharging the raw cooling water back to the body of water;

pumping cooling fluid for cooling a battery bank on the marine vessel through a closed cooling circuit;

facilitating with a heat exchanger an exchange of heat between the raw cooling water in the open cooling circuit and the cooling fluid in the closed cooling circuit so as to cool the cooling fluid in the closed cooling circuit;

sensing water with a water sensor to determine whether the lift pump is connected to the body of water, the water sensor being in communication with a control circuit;

sensing with a depth transducer a depth of the body of water in which the marine vessel is situated, the depth transducer being in communication with the control circuit;

applying electricity to a corrosive preventing submergible anode, the control circuit sensing a voltage of the submergible anode; and preventing with the control circuit operation of the lift pump when at least one of the water sensor does not sense water, the depth transducer does not sense a valid depth, and the voltage of the submergible anode is outside of a threshold value.

18. The method according to claim 17, comprising diagnosing with the control circuit a system fault when the control circuit determines that one of the water sensor, depth transducer and submergible anode indicates that the lift pump is connected to the body of water and another of the water sensor, depth transducer and submergible anode indicates that the lift pump is not connected to the body of water.

* * * * *

UNITED STATES PATENT AND TRADEMARK OFFICE

CERTIFICATE OF CORRECTION

PATENT NO. : 8,864,538 B1
APPLICATION NO. : 13/749297
DATED : October 21, 2014
INVENTOR(S) : Jason S. Arbuckle, Daniel J. Balogh and Matthew S. Krabacher It is certified that error appears in the above-identified patent and that said Letters Patent is hereby corrected as shown below:

In the Claims

In Claim 2, Column 9, Line 13 to Column 10, Line 13: “ma” should instead read --in a--.

In Claim 3, Column 10, Line 14: “Control” should instead read --control--.

In Claim 7, Column 10, Line 63: “Wherein” should instead read --wherein--.

Signed and Sealed this
Twenty-first Day of April, 2015

Michelle K. Lee

Michelle K. Lee
*Director of the United States Patent and Trademark Office*